US005740490A

United States Patent [19]

Yamashita et al.

[11] Patent Number: 5,740,490

[45] Date of Patent: Apr. 14, 1998

[54] COPIER MANAGEMENT SYSTEM

[75] Inventors: Yuji Yamashita; Jiro Nagira; Yasuhiro Hashimoto; Hiroshige Utatsu, all of Osaka, Japan

[73] Assignee: Mita Industrial Co., Ltd., Osaka, Japan

[21] Appl. No.: 762,443

[22] Filed: Dec. 9, 1996

[30] Foreign Application Priority Data

Dec. 14, 1995 [JP] Japan ..... 7-325812

[51] Int. Cl.[6] ..... G03G 15/00

[52] U.S. Cl. ..... 399/8; 377/16; 395/184.01; 399/10

[58] Field of Search ..... 399/8–10, 43; 377/15, 16; 395/184.01

[56] References Cited

U.S. PATENT DOCUMENTS 5,343,276 8/1994 Yamashita et al. ..... 399/8

5,596,390 1/1997 Sawada ..... 399/8

*Primary Examiner*—William J. Royer

*Attorney, Agent, or Firm*—Beveridge, DeGrandi, Weilacher & Young, LLP

[57] ABSTRACT

A device for management is attached to a copier, and the device for management is connected to a host computer at a management center via a telephone line. In a database of the host computer are provided a field for calculating an MCBJ since resetting or in a predetermined period, and a field for calculating a total MCBJ of copiers of a same model. Based on comparison between results obtained in these two fields, a warning is issued. Moreover, an MCBJ of a copier in a predetermined period is retained in the database for three consecutive such periods, so that a trend of the MCBJ of the copier is traced. A rising tendency of the MCBJ is judged from a combination of two trend-indicating values, one comparing an MCBJ two periods before with a current MCBJ and the other comparing the MCBJ two periods before with an MCBJ one period before. If the rising tendency exceeds a predetermined factor, a warning is issued.

6 Claims, 9 Drawing Sheets

ENCLOSED NUMBERS INDICATE WARNED COPIERS.

ENCLOSED NUMBERS INDICATE WARNED COPIERS.

GRADUAL DETERIORATION DUE TO COMPORNENT WEAR ETC.

PAPER JAMS START TO OCCUR WHEN A COMPONENT BECOMES FAULTY

ABRUPT DETERIORATION DUE TO A CHANGE IN OPERATING CONDITION ETC.

COPIER MANAGEMENT SYSTEM

BACKGROUND OF THE INVENTION

1. Field of the Invention

The present invention relates to an electronic photocopier management system that systematically performs data communication and network management, specifically to an improvement on the automatic warning function for issuing warnings for copiers having troubles in order to support copier maintenance.

2. Description of the Prior Art

Electronic photocopiers require various kinds of maintenance, such as replenishment of toner and paper, to maintain their copying functions. For this reason, the users of photocopiers usually sign a contract with a management center such as a maintenance service provider for long-term management of copiers in terms of various aspects of their maintenance as mentioned above. And, to enable the management center to carry out the contract without fail, there is usually provided a copier management system that is operated between the management center and the individual copiers regarded as terminals.

Generally, such a copier management system is constructed by connecting communications control devices attached to individual copiers to a host computer installed at a management center by way of public telephone lines. In this system, the host computer receives from the devices every kind of data, such as data for calling a serviceperson, concerning the copiers. Moreover, the host computer also sets on the devices of the individual copiers a variety of data, such as the telephone number of the host computer, the time at which regular dialing takes place, and the number of copies permitted to be made under the contract. Thus, the devices communicate with the host computer on the basis of data set as described above, and, in this way, the copiers are collectively managed.

In addition, in recent years, as a part of such host-computer-based copier management, some copier management systems have come to be provided with an automatic warning function. The automatic warning function recognizes copiers that, for some reason, show a lower MCBJ (mean copy count between paper jams) or MCBC-CODE (mean copy count between trouble-related serviceperson call code) than specified values, and issues a warning to the communications control devices of such copiers.

In the above description, a MCBJ is a value obtained by dividing the total count of copies produced by a copier in a predetermined period, e.g. the period after the copier's delivery until a predetermined time has elapsed, by the count of paper jams that have occurred in that period. Similarly, a MCBC-CODE is a value obtained by dividing the total count of copies produced by a copier in a predetermined period by the count of troubles that have occurred in that period and required dispatch of a serviceperson. Conventionally, for copiers of the same model, a standard value of the MCBJ or MCBC-CODE is determined from the maintenance history of that model as a reference value, so that, when the MCBJ or MCBC-CODE of a copier becomes lower than that value, the copier is judged to be suffering from degraded performance and is given a warning to that effect.

However, even though it is essential, in the conventional system, to recognize copiers whose MCBJ or MCBC-CODE is lower than the reference value, it is extremely difficult to determine such a reference value properly. This is because, even among copiers of the same model, copiers differ in their total performance from one another, and accordingly it is not possible to determine a threshold value that can be applied to any copier. Moreover, copiers of the same model can have significantly better total performance after a partial design or specification change that may take place at any time as long as the model remains in production and under development. In such a case, an elaborately determined reference value may become useless instantly.

Furthermore, in cases where the performance of a copier deteriorates naturally and gradually with time, a warning is not issued until the copier's MCBJ or MCBC-CODE becomes below the reference value. This implies that, for a copier that exhibits superb initial performance, a warning will not be issued until its performance deteriorates considerably.

Take the MCBJ, for example. In a copier, if one paper jam occurs every 1,000 copies produced, the MCBJ is calculated to be 1,000. However, if two paper jams occur in the same period, the MCBJ is calculated to be 500. Thus, the additional paper jam count greatly affects the MCBJ for the worse. By contrast, if 100 paper jams occur every 100,000 copies produced, the MCBJ is calculated to be 1,000. If 110 paper jams occur in the same period, the MCBJ is calculated to be 909. Thus, the additional paper jam count does not affect the MCBJ significantly.

In this way, because the MCBJ or MCBC-CODE is generally calculated by dividing the total count of copies produced since the copier's delivery by the count of troubles that have occurred in the same period, the MCBJ or MCBC-CODE comes to change less as more time elapses after the delivery, that is, as more copies are produced. By contrast, it can also happen that, with a copier that had poor initial performance but has since been improved gradually by later component replacement or other maintenance, a warning continues to be issued long after the copier's performance has reached a satisfactory level owing to such improvement.

SUMMARY OF THE INVENTION

To achieve the above object, the present invention is applied to a copier management system comprising a communications control device that is attached to a copier so as to transmit copier management data needed for managing that copier and a host computer that is connected to the communications control device by way of a communication network so as to collectively manage data from that communications control device. Here, according to a first construction of the present invention, the host computer is provided with an automatic warning function as described below.

Specifically, the host computer is provided with a first calculation means that calculates, for each of copiers registered in a database for management, a frequency of troubles occurring after a trouble cause removal or a frequency of troubles in a predetermined period; a second calculation means that calculates an average total frequency of troubles for copiers of a same model as a targeted copier; and a warning means that compares a result of the first calculation means and a result of the second calculation means in order to issue a warning based on a comparison result. In this construction, as an index for calculating a frequency of troubles, it is possible to use a MCBJ, a MCBC-CODE, a MDBJ (mean document count between paper jams), or a toner consumption amount.

In the above construction, the predetermined period in which the first calculation means calculates a frequency of troubles is extended when a precondition for correct calculation of a frequency of troubles is not satisfied. Moreover, it is preferable that the warning means use as a threshold value a predetermined factor times an average total frequency of troubles for copiers of a same model as a targeted copier as calculated by the second calculation means, and that this threshold value be compared with a frequency of troubles as calculated by the first calculation means.

In this way, the threshold value is determined from a value, such as average MCBJ, that indicates an average frequency of troubles for all copiers of the same model, whereas the index indicating a frequency of troubles is referred to only every predetermined period or every maintenance occasion, so that whether a copier's condition is satisfactory or not can be judged at any particular point of time. As a result, since an average value for all copiers of the same model is used as a reference value, a configuration fit for the performance of a particular model can be achieved automatically. Moreover, although the average value for all copiers of the same model does change constantly, the reliability of a warning is not harmed by such change in the above construction, because, a warning is issued based on latest data. Furthermore, since a warning related to a frequency of troubles is issued every resetting occasion or every specified period, each warning can be made fit for a copier's performance at a given point of time.

Alternatively, in a second construction of the present invention, the host computer is provided with an automatic warning function realized by a data retaining means that retains for a predetermined time a frequency of troubles occurring in a specified period for each copier registered in a database for management; and a warning means that issues a warning based on a trend of a frequency of troubles as observed in data retained for a specified period in the data retaining means. In this way, the trend of a value such as the MCBJ is monitored for a predetermined period, so that, regardless of the value of the MCBJ etc., a warning can be issued also for a copier whose performance is deteriorating gradually. As a result, an abrupt change that may elude monitoring based on a simple average value can be detected as soon as it occurs.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
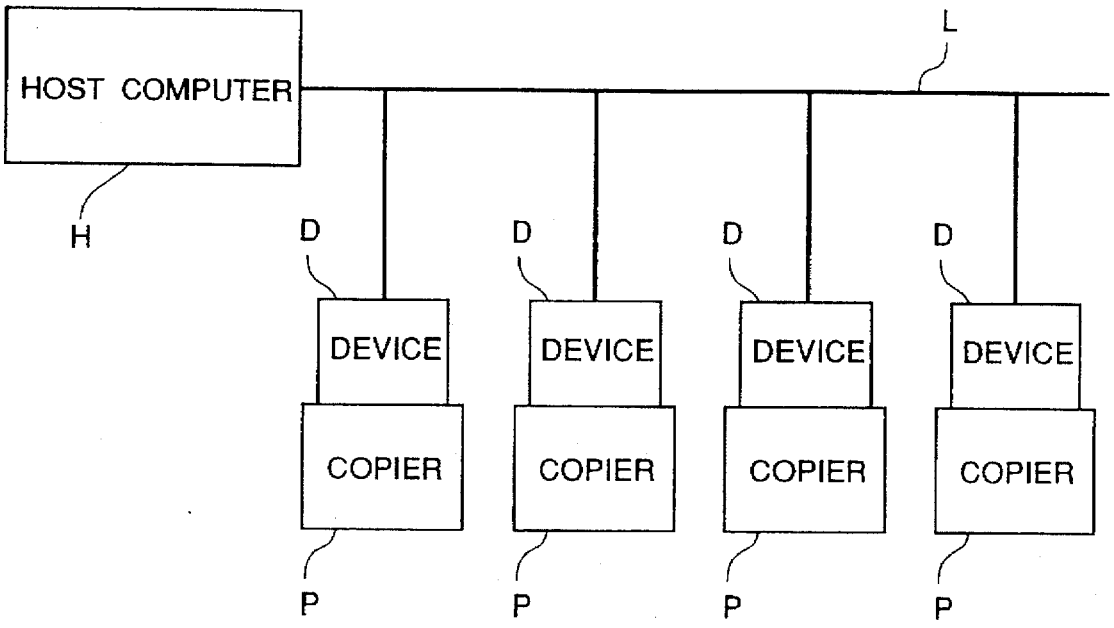
FIG. 1 is a block diagram showing the outline of an example of the copier management system according to the present invention.

Hereinafter, an embodiment of the present invention will be described with reference to the drawings. FIG. 1 schematically shows an example of the copier management system embodying the present invention. As shown in this figure, the copier management system consists of copiers P that are individually installed at the sites of a plurality of users, and a host computer H installed at the management center of a maintenance company. Each copier P is equipped with a communications control device D serving as a terminal device, which is connected to the host computer H by way of a public telephone line L.

Figure 2:
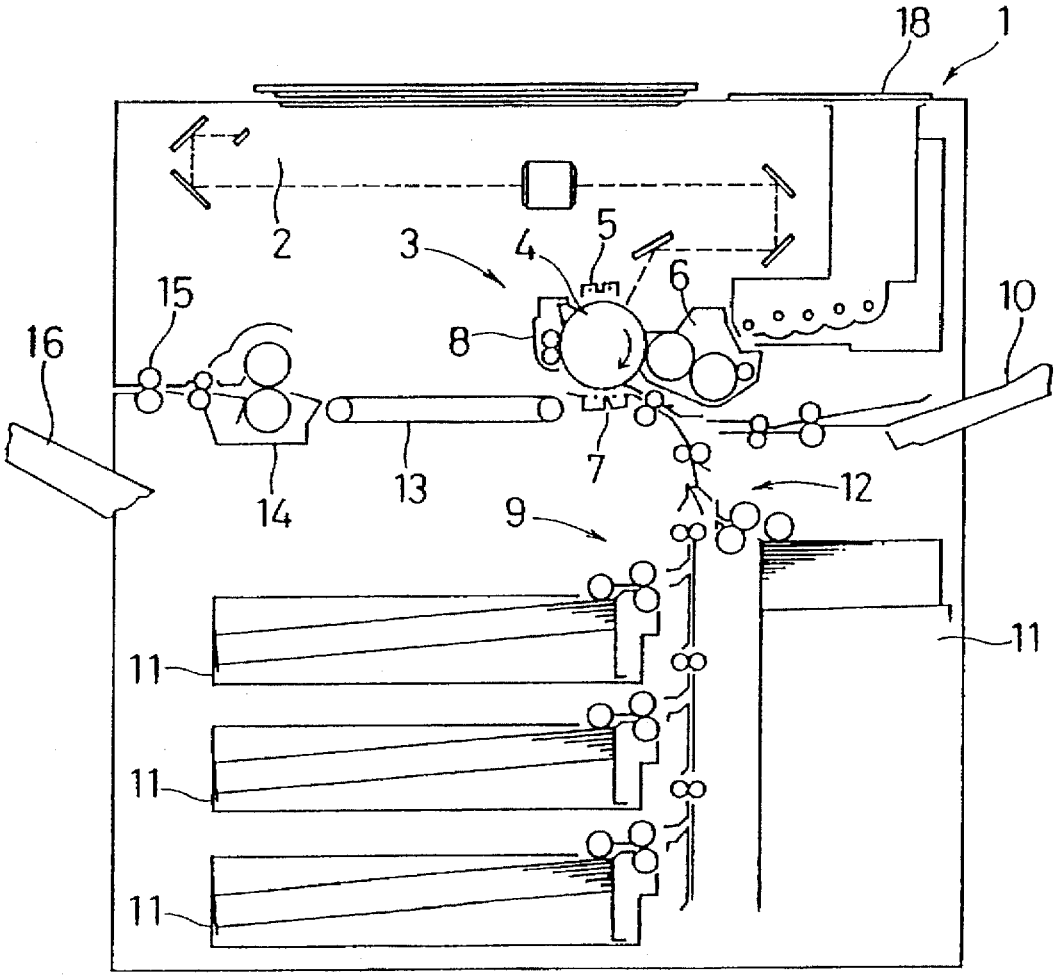
FIG. 2 is a cross-sectional view schematically showing the copier.

FIG. 2 shows the construction of the copier P. As shown in this figure, the copier P is provided with an optical system 2 fitted in the upper part of the copier body 1. The optical system 2 serves to read an original and comprises a light source, mirrors, a lens unit, and other components. In the central part of the copier body 1 is provided an image forming section 3 for forming an image with toner based on the read original. The image forming section 3 has a photosensitive drum 4, on the surface of which an electrostatic latent image is formed. Arranged around the photosensitive drum 4 are a main charger 5, a developing unit 6, a transferring and separating charger 7, and a cleaning unit 8.

In the lower part of the copier body 1 is provided a paper feed section 9. The paper feed section 9 comprises a bypass table 10 that is disposed in the right-hand part of the copier body 1 in FIG. 2, a plurality of paper feed cassettes 11 arranged vertically in the lower part of the copier body 1, and a paper transfer unit 12 for transferring paper sheets stocked in the bypass table 10 or paper feed cassettes 11 to the image forming section 3. Arranged on the downstream side of the image forming section 3 along the paper transfer direction are a paper ejecting conveyor 13 for conveying paper sheets to the left-hand part of the copier in FIG. 2, a fixing unit 14 for fixing a toner image on paper by fusion, ejecting rollers 15 for ejecting paper sheets after image fixation, and an ejected-paper tray 16 for stocking ejected paper sheets.

Figure 3:
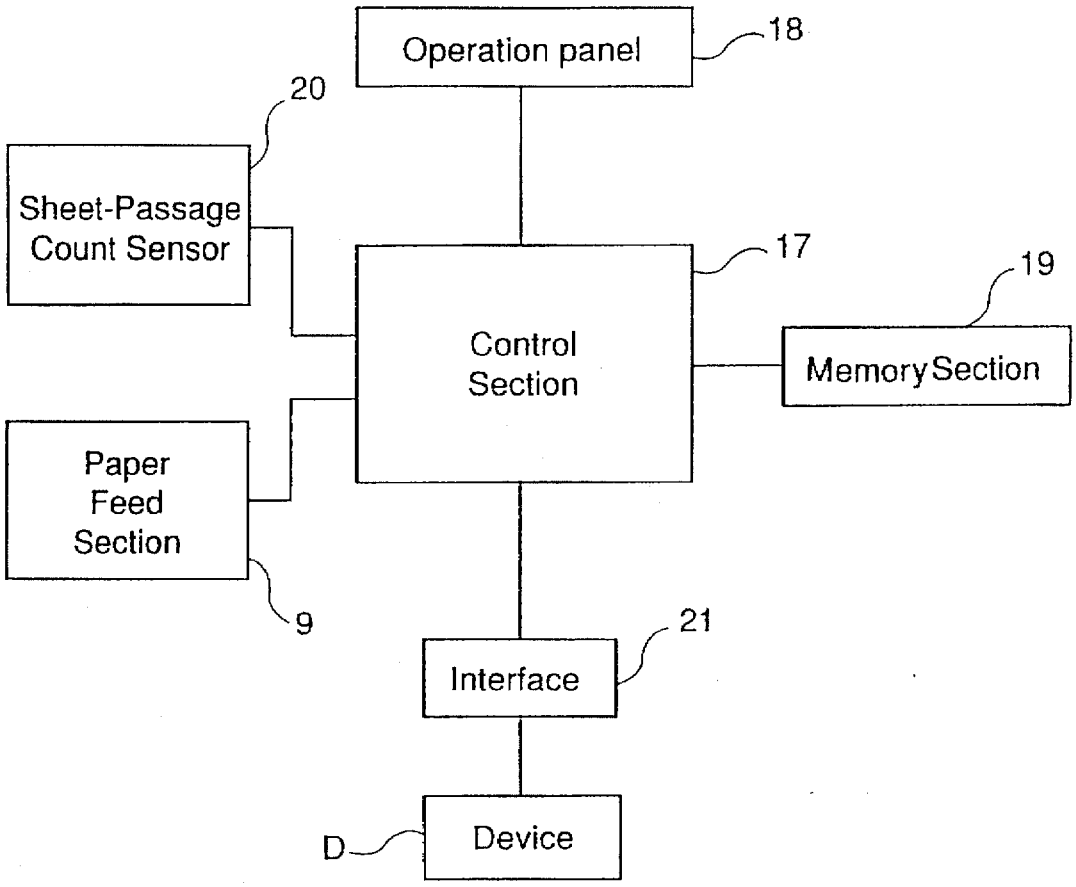
FIG. 3 is a block diagram showing the control section of the copier.

The copier body 1 is further equipped with a control section 17 shown in FIG. 3. The control section 17 is constructed as a microcomputer system including a CPU, a RAM, a ROM, a variety of drivers, and a variety of I/O ports. To the control section 17, an operation panel 18 is connected.

As shown in FIG. 2, the operation panel 18 is disposed on the upper surface of the copier body 1, and includes an input keypad section and a display section composed of liquid crystal display devices, light emitting diodes, etc.

To the control section 17, a memory section 19 for storing a variety of operation data is connected. The memory section 19 stores, for example, the total count of copies produced by the copier body 1. Also connected to the control section 17 are a sheet-passage count sensor 20 for counting how many images have been formed, and a paper feed section 9 for feeding paper from paper feed cassettes 11.

In practice, the sheet-passage count sensor 20 consists of a plurality of sensors arranged in appropriate positions along the paper feed path from each paper feed cassette 11 through the image forming section 3 and the fixing unit 14 to the ejected-paper tray 16, so that, every time a complete and correct passage of a paper sheet is detected, the total count stored in the memory section 19 is incremented. Furthermore, the control section 17 is connected through an interface 21 to the copier management device D, so that the copy count counted by the sheet-passage count sensor 20 is transmitted to that device D.

Figure 4:
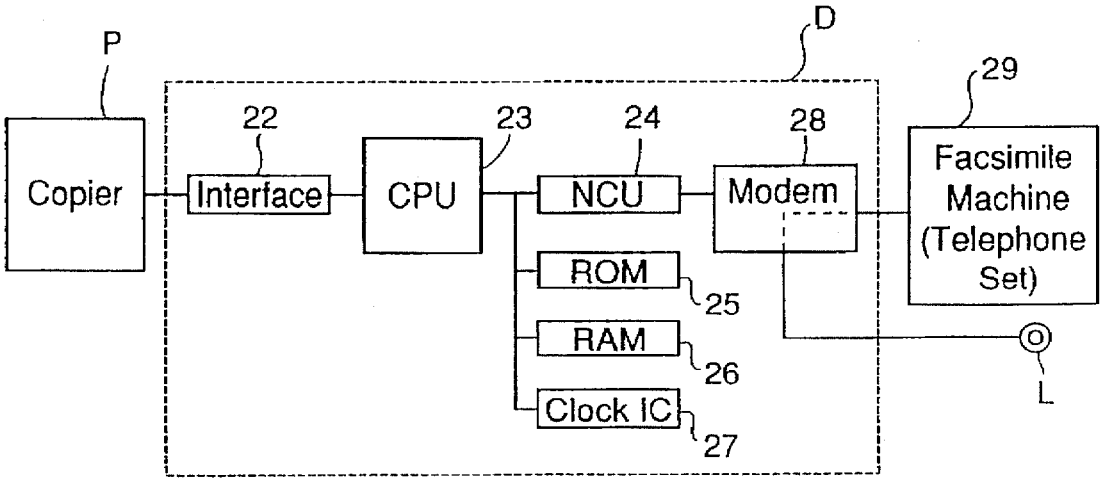
FIG. 4 is a block diagram showing the construction of the device.

The copier management device D, which serves to transmit data required for managing the copier P, is, as shown in FIG. 4, equipped with a serial interface 22 that is connected to the copier body 1. The serial interface 22 is eventually connected to a CPU 23. The CPU 23 is formed as a microcomputer system, and is connected to a NCU (network control unit) 24, a ROM 25, a RAM 26, and a clock IC 27. The NCU 24 is connected to a modem 28, and the modem 28 is in turn connected to a public telephone line L.

Note, however, that it is not practical to use the telephone line L exclusively for the device D of the copier. In reality, as shown in FIG. 4, a telephone line for a facsimile machine (or telephone set) 29 is made to take a detour through the device D, and the device D is set for transmission only, so that, when the device D receives a call through the telephone line, the device D does not answer the call but transfers it to the facsimile machine or telephone set. Accordingly, in the management system of this embodiment, the host computer H cannot establish a connection with the device D without performing a special operation to enable the device to answer a call.

Figure 5:
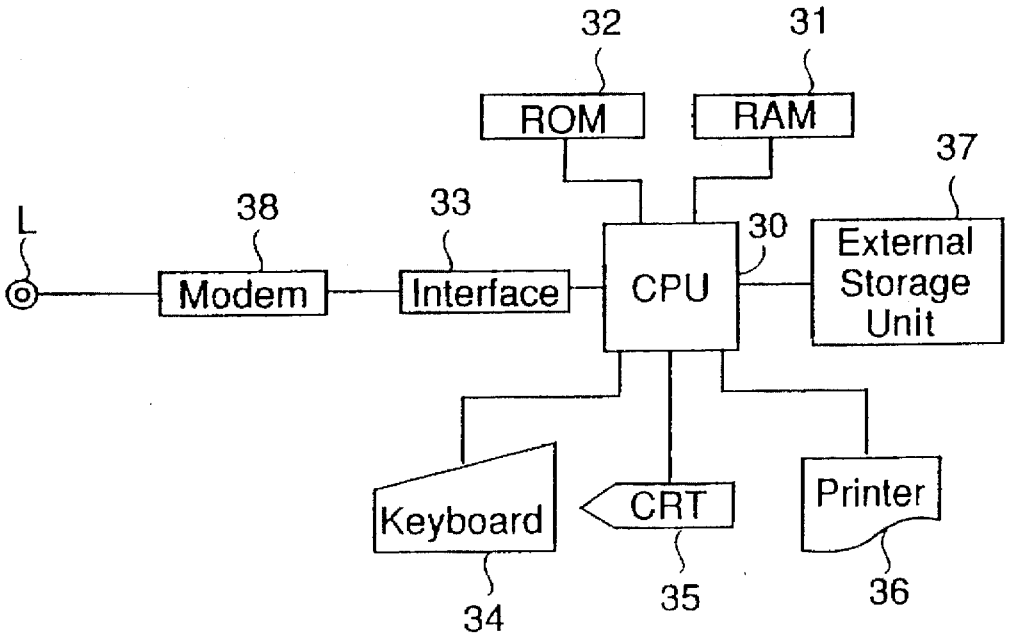
FIG. 5 is a block diagram showing the construction of the host computer.

As shown in FIG. 5, the host computer H is provided with a CPU 30, to which a RAM 31, a ROM 32, and an input/output interface 33 are connected. Moreover, to the CPU 30, a keyboard 34 for entering data, a CRT 35 for displaying data, a printer 36 for printing data, an external storage unit 37, and other devices are connected. The input/output interface 33 is provided with input/output terminals such as RS-232C ports, and is connected through a communications modem 38 to a public telephone line L.

The host computer H receives data transmitted from the device D and manages the copier P collectively on the basis of the received data. To achieve this, the host computer H not only receives from the device D every kind of data, including data for calling a serviceperson, concerning the copiers P, but also sets initial data for the copier P, for example, by setting on the device D a variety of data such as the telephone number of the host computer H, the time at which periodical dialing takes place, and the number of copies permitted to be made under the contract.

Furthermore, the host computer H is provided with a function for automatically issuing warnings to copiers P having troubles in order to support their maintenance. In the embodiment under discussion, this automatic warning function has a distinctive feature. Specifically, here, the host computer H is provided with such an automatic warning function that lists and prints copiers in which the frequency of paper jams or serviceperson calls (calls for a service person to request repair of a trouble) is high or constantly increasing.

In a database of the host computer H, the following fields are provided to calculate the MCBJ, which is one of the indices for trouble frequency calculation.

Paper jam count since delivery

Paper jam count since resetting

Paper jam count in a predetermined period

MCBJ since delivery

MCBJ since resetting

MCBJ in a predetermined period

Copy count since delivery

Copy count since resetting

Copy count in a predetermined period

Here, delivery denotes the date and time at which a copier was delivered to the site of its user, and resetting denotes issuing of a command for MCBJ recalculation when component replacement or other maintenance work was performed to remove the causes of paper jams. A predetermined period refers to the time intervals at which warnings are issued automatically. Note however that a predetermined period is extended when certain preconditions are not satisfied. Preconditions here denote conditions to be satisfied to guarantee correct MCBJ calculation, and include conditions such as that more than one paper jam has occurred, and that an actual copy count has exceeded an average copy count.

Moreover, in addition to the above fields, the host computer H is provided with other fields for calculating a total MCBJ for copiers P of the same model. The host computer H compares this model-specific total MCBJ with the above-mentioned MCBJ since delivery and MCBJ since resetting to issue a warning on the basis of such comparison. However, according to this comparison method, a warning is issued for all copiers that exhibit poorer MCBJ records than the model average. To prevent this, the model-specific MCBJ is multiplied by a predetermined factor to obtain a threshold value as a reference value. And, by adjusting this factor to the actual condition of the copiers P, it is possible to determine what portion of the copiers P should be targeted by a warning.

Moreover, apart from the above process, the MCBJ of a copier in a particular period is retained in the database for three consecutive such periods, so that the trend of the copier's MCBJ is traced. Specifically, the rising tendency of the MCBJ is judged from a combination of two trend-indicating values, one calculated by comparing the MCBJ two periods before with the current MCBJ and the other by comparing the MCBJ two periods before with that one period before. Thus, if the rising tendency exceeds a predetermined factor, a warning is issued. In this case, by adjusting this factor adequately, it is possible to determine what portion of the copiers should be targeted by a warning.

Figure 6:
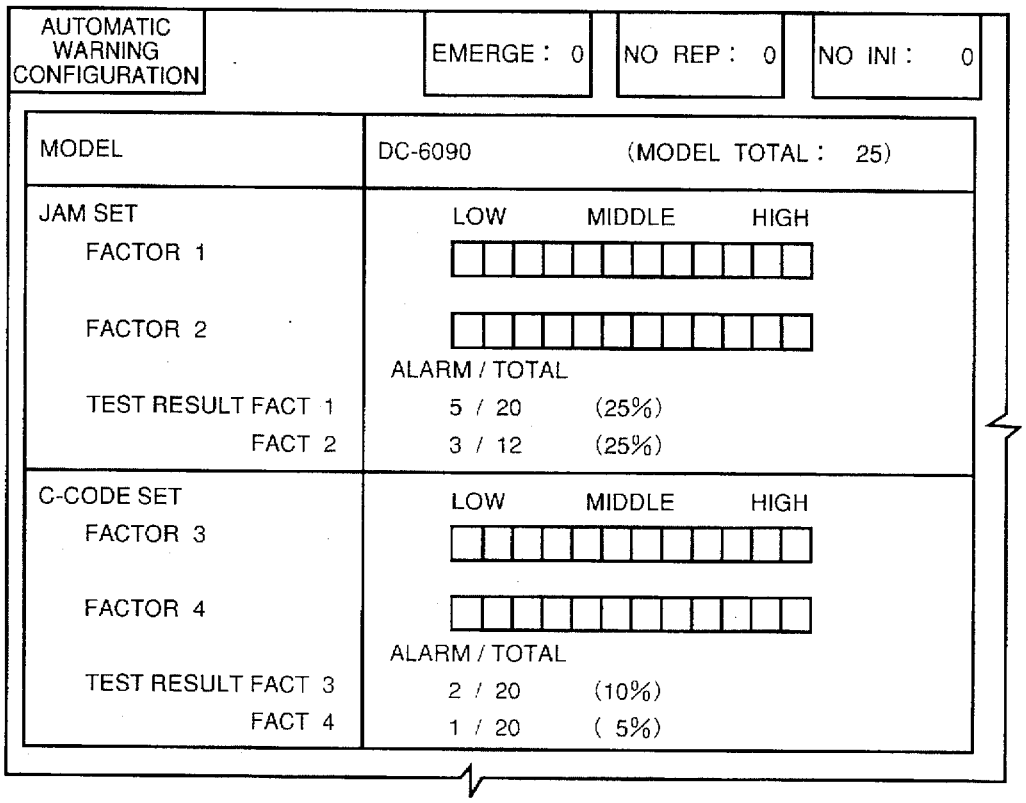
FIG. 6 is a diagram showing an example of the layout of the screen for the listing of automatic warnings.

The above described automatic warning function is also capable of listing and printing copiers to which warnings have been issued automatically every predetermined period. FIG. 6 shows an example of the layout of the screen for the listing of automatic warnings. Note that, as an index for calculating a frequency of troubles, it is possible to use, instead of the above-mentioned MCBJ, an MCBC-CODE, an MDBJ, a toner consumption amount, or the like.

Next, the automatic warning function of the host computer H will be described in more detail below. The automatic warning function can be configured differently for each copier model. In addition, it can be configured differently between paper jam records and serviceperson call records for the same model. As the time interval for issuing a warning, it is possible to select from: every specified day of week, every second specified day of week, every specified day of month, or never (warning OFF). The selection can be made on a system parameter screen.

Figure 7:
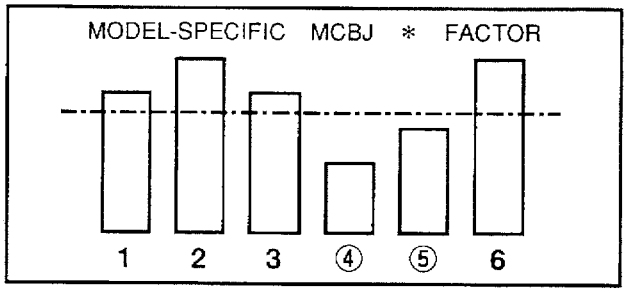
FIG. 7 is a graph in explanation of the operation for selecting a copier that shows poor MCBJ records after paper-jam-directed repairs.

Listing of copiers P proceeds as follows. First, as shown in FIG. 7, if there are copiers that exhibit a poorer paper jam record (MCBJ) than the value of the factor times the model-specific MCBJ even after resetting, i.e. after paper-jam-directed repairs, such copiers are listed. In the figure, the encircled numbers indicate the copiers P that are listed. Here, the model-specific MCBJ denotes the average paper jam frequency for a specific model.

The above-mentioned factor is set by manipulating the FACTOR 1 bar shown in FIG. 6. The model-specific MCBJ is varying constantly, and therefore the threshold value for issuing a warning rises according as the model-specific average MCBJ rises.

Figure 8:
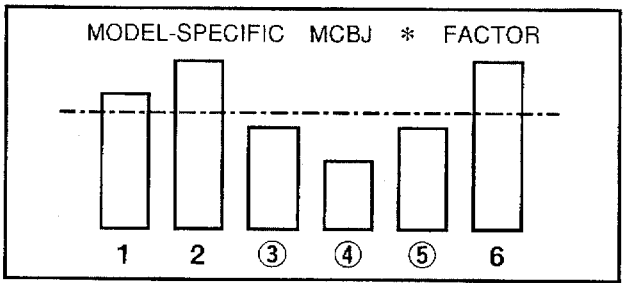
FIG. 8 is a graph in explanation of the operation for selecting a copier that shows poorer MCBJ records during a warning period than expected from the value of a predetermined factor times the model-specific MCBJ.

Secondly, as shown in FIG. 8, if there are copiers that exhibit a poorer MCBJ record than the value of the factor times the model-specific MCBJ within one warning period, such copiers are listed. In the figure, the encircled numbers indicate the copiers P that are listed. Also here, the above-mentioned factor is set by manipulating the FACTOR 1 bar.

Figure 9A:
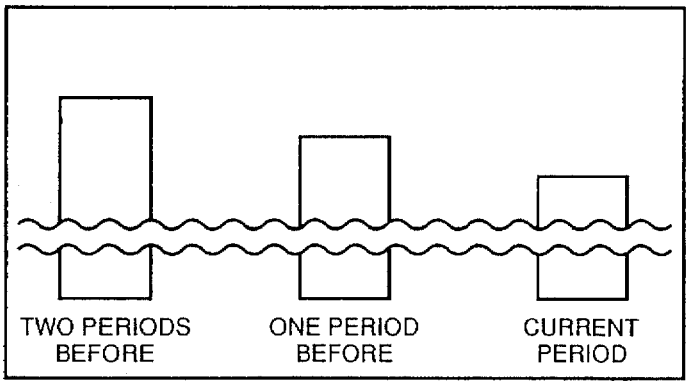
FIGS. 9A, 9B, and 9C are graphs in explanation of the operation for selecting a copier whose paper jam frequency is increasing.
Figure 9B:
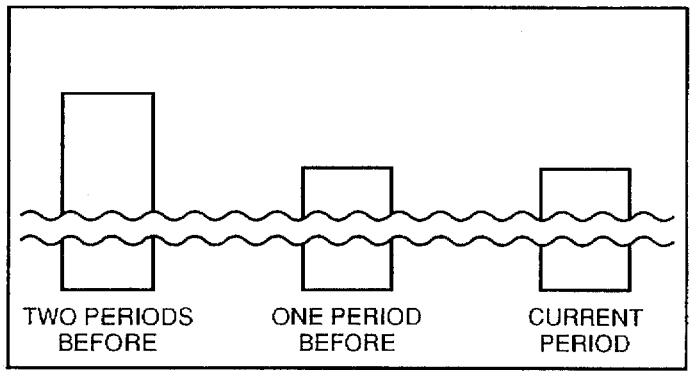
Figure 9C:
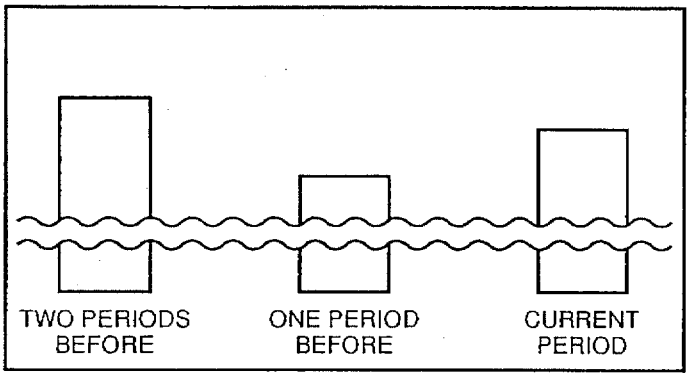

Thirdly, if there are copiers that exhibit an increase in the paper jam frequency, such copiers are listed. More specifically, as shown in FIGS. 9A, 9B, and 9C, by comparing the MCBJs in three consecutive warning periods, those copiers whose MCBJ one period before is lower by more than a predetermined percentage (e.g. 10%) than that two periods before are extracted. In addition, those copiers whose MCBJ in the current period is lower by 1/1.1 (i.e. approximately 0.9) times the just-mentioned predetermined percentage than that two periods before are also extracted. Eventually, warnings are issued to those copiers P which satisfy both of these two conditions. The above-mentioned predetermined percentage is set by manipulating the FACTOR 2 bar shown in FIG. 6.

An increase in the paper jam frequency of a copier P as described just above is most probably observed:

(1) in a gradually-increasing pattern, when the MCBJ worsens gradually as the copier's components wear naturally;

(2) in a stepwise-increasing pattern, when paper jams start to occur just after, say, some component of the copier has become faulty; or (3) in an sporadically-increasing pattern, when a copier's performance deteriorates abruptly owing to a change in the operating condition.

The host computer H can select copiers P on the basis of any combination of the above three tendencies, combining desired conditions with the logical OR operation. In this case, the number of copiers P that satisfy given conditions, e.g. that are to be selected as targets of a warning, depends on how the FACTORS are set. The actual number of copiers P satisfying given conditions at a given FACTORS setting can be displayed for confirmation by pressing the TEST key in the keyboard 34 shown in FIG. 5. In this way, on the basis of the number of copiers thus displayed, the FACTORS are set to adequate positions. However, the total number of copiers of a particular model displayed there is based on a total number as registered in the host computer H, and therefore it may differ from that obtained as a result of such testing (this is the total number of copiers for which calculation of the MCBJ etc. is possible). After testing, test results including the data on the targeted copiers can be printed from the printer 36.

Figure 10:
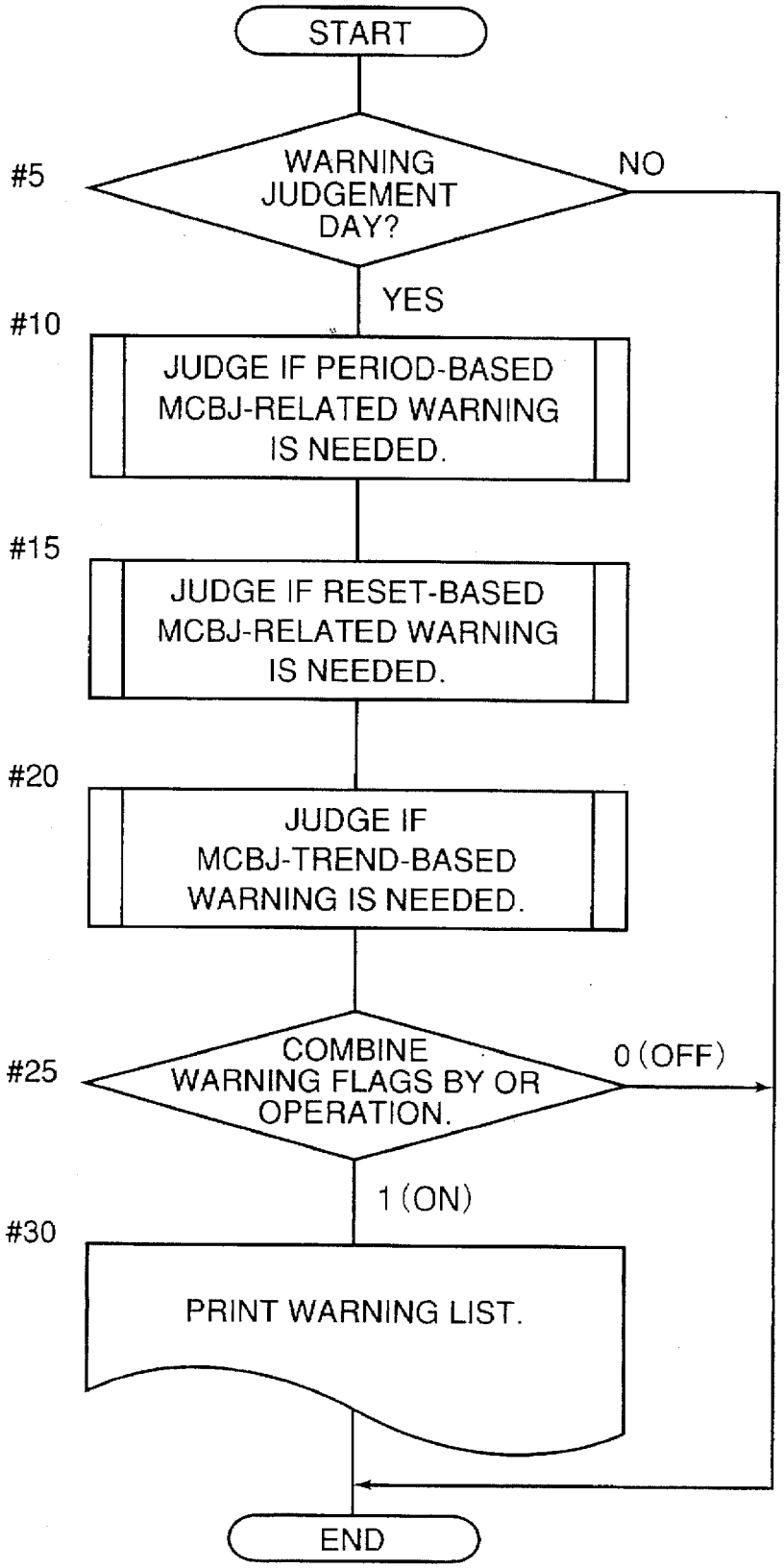
FIG. 10 is a flowchart showing the operation of the host computer when it issues an MCBJ-related warning.

FIGS. 10 to 13 show the operation of the CPU 30 of the host computer H when the above described automatic warning function is in operation. The host computer H performs the warning operation as follows. In FIG. 10, in step #5, the host computer H judges whether or not the current date falls on a day on which a warning-related judgment is expected. If it does, then, in step #10, the host computer H executes a subroutine for judging whether a period-based MCBJ-related warning needs to be issued or not.

Figure 11:
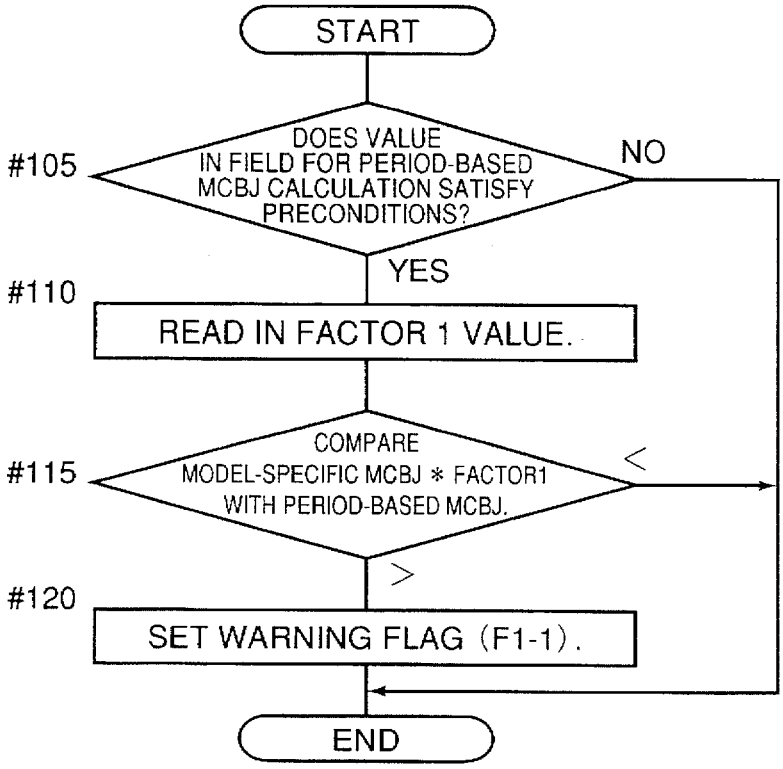
FIG. 11 is a flowchart showing the operation of the host computer when it judges whether a period-based MCBJ-related warning should be issued or not.

In FIG. 11, the operation for judging whether a period-based MCBJ-related warning needs to be issued or not proceeds as follows. In step #105, the host computer H judges whether the value in the field for period-based MCBJ calculation satisfies the preconditions or not. If it does, then, in step #110, the host computer H reads in the setting of FACTOR 1 shown in FIG. 6. Then, in step #115, the host computer H compares value A, which is the model-specific average MCBJ multiplied by the setting of FACTOR 1, with value B, which is the current period-based MCBJ. If A is greater than B, then, in step #120, the host computer H sets a warning flag (F1-1), and then proceeds to step #15 in FIG. 10.

If, in step #105, the value in the field for period-based MCBJ calculation does not satisfy the preconditions, or if, in step #115, A is less than B, then the host computer H does not judge whether a period-based MCBJ-related warning needs to be issued or not, and proceeds to step #15. Revert to FIG. 10. In step #15, the host computer H executes a subroutine for judging whether a resetting-based MCBJ-related warning needs to be issued or not.

Figure 12:
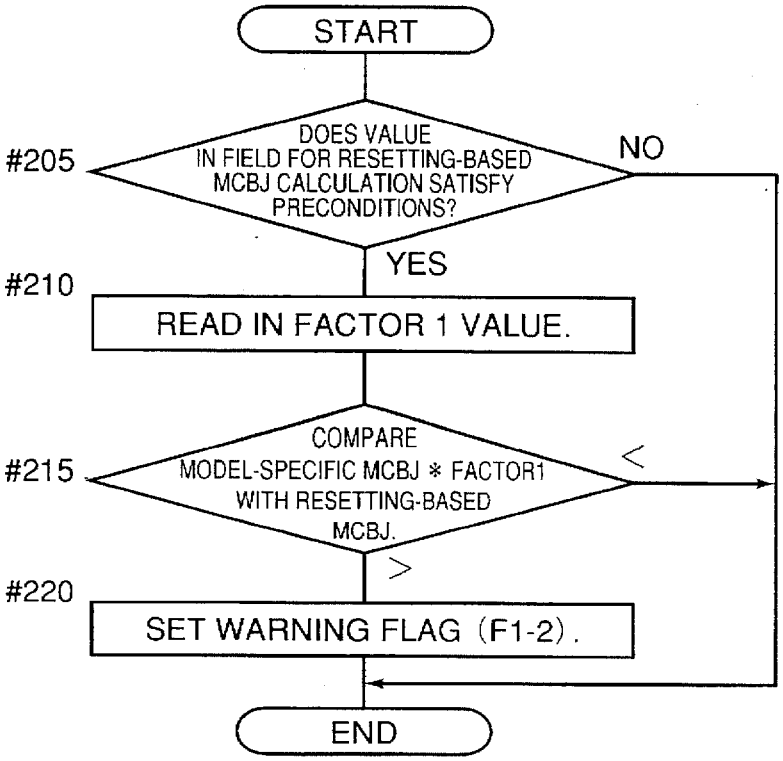
FIG. 12 is a flowchart showing the operation of the host computer when it judges whether a resetting-based MCBJ-related warning should be issued or not.

In FIG. 12, the operation for judging whether a resetting-based MCBJ-related warning needs to be issued or not proceeds as follows. In step #205, the host computer H judges whether the value in the field for resetting-based MCBJ calculation satisfies the preconditions or not. If it does, then, in step #210, the host computer H reads in the setting of FACTOR 1 shown in FIG. 6. Then, in step #215, the host computer H compares value C, which is the model-specific average MCBJ multiplied by the setting of FACTOR 1, with value D, which is the current resetting-based MCBJ. If C is greater than D, then, in step #220, the host computer H sets a warning flag (F1-2), and then proceeds to step #20 in FIG. 10.

If, in step #205, the value in the field for resetting-based MCBJ calculation does not satisfy the preconditions, or if, in step #215, C is less than D, then the host computer H does not judge whether a resetting-based MCBJ-related warning needs to be issued or not, and proceeds to step #20. Revert to FIG. 10. In step #20, the host computer H executes a subroutine for judging whether an MCBJ-trend-based warning needs to be issued or not.

Figure 13:
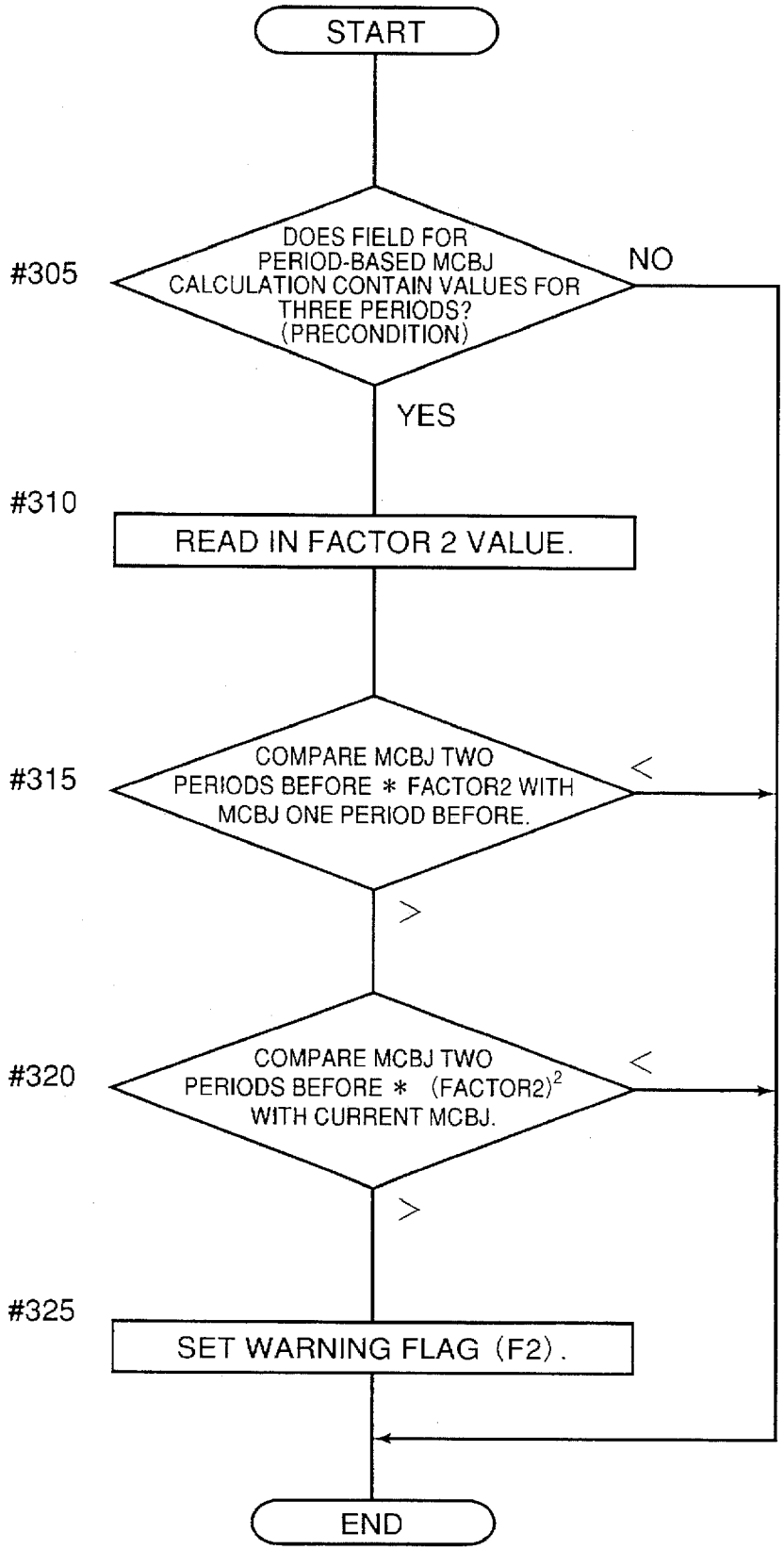
FIG. 13 is a flowchart showing the operation of the host computer when it judges whether an MCBJ-trend-based warning should be issued or not.

In FIG. 13, the operation for judging whether an MCBJ-trend-based warning needs to be issued or not proceeds as follows. In step #305, the host computer H judges whether or not the field for period-based MCBJ calculation contains three values respectively representing the MCBJ two periods before, the MCBJ one period before, and the MCBJ in the current period. If it does, then, in step #310, the host computer H reads in the setting of FACTOR 2 shown in FIG. 6. Then, in step #315, the host computer H compares value E, which is the MCBJ two periods before multiplied by the setting of FACTOR 2, and value F, which is the MCBJ one period before. If E is greater than F, then, in step #320, the host computer H compares value G, which is the MCBJ two periods before multiplied by the square of the setting of FACTOR 2, and value H, which is the current MCBJ. If G is greater than H, then, in step #325, the host computer H sets a warning flag (F2), and then proceeds to step #25 in FIG. 10.

If, in step #305, the field for period-based MCBJ calculation does not contain three values, or if, in step #315, E is less than F, or if, in step #320, G is less than H, then the host computer H does not judge whether an MCBJ-trend-based warning needs to be issued or not, and proceeds to step #25. In this embodiment, the factor used in step #320 for setting the threshold value is defined as follows:

$$(\text{MCBJ}*\text{Factor2})^2.$$

However, it is also possible to define the factor in other ways such as:

MCBJ*Factor2;

MCBJ*Factor2*[Constant];

$(\text{Factor2})^2$;

Factor2*Factor3, where Factor 3 is a variable parameter.

Revert to FIG. 10. In step #25, the host computer H combines the warning flags using the OR operation. If the combined result is "1", then, in step #30, the host computer H prints a warning list. If, in step #25, the combined result is "0", or if, in step #5, the current date does not falls on a day on which a warning-related judgment is expected, then the host computer H does not print a warning list.

Although the MCBJ is used as the index indicating the frequency of troubles in the above described embodiment, it is also possible to run the warning function on the basis of serviceperson call records according to the same configuration as with paper jam records. Moreover, it is also possible to configure the warning function differently for paper jam records and serviceperson call records. Moreover, although the host computer automatically prints a warning list in the above embodiment, it is also possible to display a warning list on the CRT 35 in response to user operation. Furthermore, it is also possible to give a warning directly to the device D by a separate procedure to enable the device D to answer.

As described above, according to the first construction of the present invention, a frequency of troubles occurring after a trouble cause removal or a frequency of troubles in a predetermined period is calculated for each of copiers registered in a database for management, and an average total frequency of troubles for copiers of a same model as a targeted copier is calculated as well, so that a warning can be issued on the basis of comparison between the results of such calculation. In this way, since an average value for all copiers of the same model is used as a reference value, a configuration fit for the performance of a particular model can be achieved automatically. Moreover, although the average value for all copiers of the same model does change constantly, the reliability of a warning is not harmed by such change, because a warning is issued based on latest data. Furthermore, since a warning related to a frequency of troubles is issued every resetting occasion or every specified period, each warning can be made fit for a copier's performance at a given point of time.

According to the second construction, a frequency of troubles occurring in a specified period is retained for a predetermined time for each copier registered in a database for management, and a warning is issued based on a trend of the frequency of troubles as observed in data retained for a specified time. In this way, regardless of the value of the MCBJ etc., a warning can be issued also for a copier whose performance is deteriorating gradually. As a result, an abrupt change that may elude monitoring based on a simple average value can be detected as soon as it occurs.

Obviously, many modifications and variations of the present invention are possible in light of the above teachings. It is therefore to be understood that within the scope of the appended claims, the invention may be practiced other than as specifically described.

What is claimed is:

1. A copier management system comprising a communications control device that is attached to a copier so as to transmit copier management data needed for managing that copier and a host computer that is connected to said communications control device by way of a communication network so as to collectively manage data from that communications control device, wherein said host computer comprises:

a first calculation means that calculates, for each of copiers registered in a database for management, a frequency of troubles occurring after a trouble cause removal or a frequency of troubles in a predetermined period, a second calculation means that calculates an average total frequency of troubles for copiers of a same model as a targeted copier, and a warning means that compares a result of said first calculation means and a result of said second calculation means in order to issue a warning based on a comparison result.

2. A copier management system as claimed in claim 1, wherein the predetermined period in which said first calculation means calculate a frequency of troubles is extended when a precondition for correct calculation of a frequency of troubles is not satisfied.

3. A copier management system as claimed in claim 1, wherein said warning means uses as a threshold value a predetermined factor times an average total frequency of troubles for copiers of a same model as a targeted copier as calculated by said second calculation means, and this threshold value is compared with a frequency of troubles as calculated by said first calculation means.

4. A copier management system as claimed in claim 1, wherein as an index for calculating a frequency of troubles is used one among an MCBJ, an MCBC-CODE, an MDBJ, and a toner consumption amount.

5. A copier management system comprising a communications control device that is attached to a copier so as to transmit copier management data needed for managing that copier and a host computer that is connected to said communications control device by way of a communication network so as to collectively manage data from that communications control device, wherein said host computer comprises:

a data retaining means that retains for a predetermined time a frequency of troubles occurring in a specified period for each copier registered in a database for management, and a warning means that issues a warning based on a trend of a frequency of troubles as observed in data retained for a specified time in said data retaining means.

6. A copier management system as claimed in claim 5, wherein as an index for calculating a frequency of troubles is used one among an MCBJ, an MCBC-CODE, an MDBJ, and a toner consumption amount.

* * * * *